US008701741B2

(12) United States Patent
Di Serio et al.

(10) Patent No.: US 8,701,741 B2
(45) Date of Patent: Apr. 22, 2014

(54) PROCESS FOR MANUFACTURING FORGINGS MADE OF LIGHT ALLOY, INCORPORATING SOLID OR THINNED-DOWN SECTIONS

(75) Inventors: Emile Thomas Di Serio, Chenas (FR); Veronique Bouvier, St. Etienne des Oullieres (FR); Romain Epale, Villefranche Sur Saone (FR)

(73) Assignee: Saint Jean Industries, Saint Jean d'Ardieres (FR)

( * ) Notice: Subject to any disclaimer, the term of this patent is extended or adjusted under 35 U.S.C. 154(b) by 0 days.

(21) Appl. No.: 13/638,945

(22) PCT Filed: Apr. 5, 2011

(86) PCT No.: PCT/FR2011/050757
§ 371 (c)(1), (2), (4) Date: Nov. 20, 2012

(87) PCT Pub. No.: WO2011/124836
PCT Pub. Date: Oct. 13, 2011

(65) Prior Publication Data

US 2013/0098575 A1 Apr. 25, 2013

(30) Foreign Application Priority Data

Apr. 6, 2010 (FR) ..... 10 52586

(51) Int. Cl.
*B22D 25/02* (2006.01)
*B22D 29/00* (2006.01)
*B22D 31/00* (2006.01)

(52) U.S. Cl.
USPC ..... 164/69.1; 164/76.1; 164/132

(58) Field of Classification Search
USPC ..... 164/69.1, 76.1, 132
See application file for complete search history.

(56) References Cited

U.S. PATENT DOCUMENTS

| | | | | |
|---|---|---|---|---|
| 6,145,184 | A * | 11/2000 | Yamanaka | 29/527.6 |
| 6,353,992 | B1 * | 3/2002 | Mizobe | 29/527.5 |
| 2008/0034919 | A1 * | 2/2008 | Valle et al. | 74/594.1 |

FOREIGN PATENT DOCUMENTS

| | | | |
|---|---|---|---|
| EP | 0119365 | A1 | 9/1984 |
| EP | 0850825 | A2 | 7/1998 |
| EP | 0850827 | A2 | 7/1998 |

(Continued)

OTHER PUBLICATIONS

International Search Report for PCT/FR2011/050757 dated Jun. 27, 2011.

(Continued)

*Primary Examiner* — Kevin P Kerns
(74) *Attorney, Agent, or Firm* — Heslin Rothenberg Farley & Mesiti P.C.

(57) ABSTRACT

The process includes: definition of the final hollow part in its internal portion after forging with deformation of solid or thinned-down sections;
modelling of the solid or thinned-down sections;
formation of the thinned-down sections by recyclable single-material cores positioned at places requiring zones with a thinned-down section, and modelling of the cores;
after modelling, definition of the semi-finished product and of the cores in their initial forms having a different configuration from the forged cores;
after casting of metal around the cores, in the prior initial form, striking of the semi-finished product with its cores resulting in the part and its cores being deformed from their initial shapes to their final shapes;
fettling of the burrs; and
removal of the cores.

7 Claims, 3 Drawing Sheets

(56) References Cited

FOREIGN PATENT DOCUMENTS

| | | | |
|---|---|---|---|
| EP | 1219367 | A1 | 7/2002 |
| WO | 0149435 | A1 | 7/2001 |
| WO | 2009050382 | A2 | 4/2009 |

OTHER PUBLICATIONS

Bouvier V et al; "Le procede COBAPRESS: un procede d'une experience de vingt cinq ans, qui a de beaux hours devant /// The COBAPRESS process: a process rich of a twenty-five years experience, with a bright future," Hommes Et Fonderie, vol. 378, Jan. 1, 2007, pp. 10-16.

* cited by examiner

PROCESS FOR MANUFACTURING FORGINGS MADE OF LIGHT ALLOY, INCORPORATING SOLID OR THINNED-DOWN SECTIONS

CROSS REFERENCE TO RELATED APPLICATIONS

This application is a national stage filing under section 371 of International Application No. PCT/FR2011/050757 filed on Apr. 5, 2011, and published in French on Oct. 13, 2011 as WO 2011/124836 A1 and claims priority of French application No. 1052586 filed on Apr. 6, 2010, the entire disclosure of these applications being hereby incorporated herein by reference.

BACKGROUND ART

The invention relates to the technical field of hot or cold forging to form hollow parts made of light alloys. The invention also relates to the foundry technology sector in which the process of casting material around a core pre-positioned and held in a mould is well known.

The invention relates to the application of the process to all technical fields to form parts with high mechanical properties and particularly for some parts or components used in the car and cycle industry but not restrictively.

The technology associated with forging hollow parts is well known. This includes, for example, the forging of ingots of pre-drilled material, and also the radial forging of forging blanks or ingots requiring time and a plurality of forging stages.

The forging of hollow parts with core pins put in place to form recesses is also known. This technique requires the use of core pin insertion mechanisms and an automated system capable of operating at the stroke rate of power hammers for good productivity. Apart from the fact that the shapes of these recesses must not be too complex as they generate the shape of the core pins, said recesses are always exposed to allow the core pins to be put in place, and create use restrictions. Additionally, the kinematics calculation is not always easy to implement.

The method for machining the parts is also known but it is costly in terms of machining time and in initial material to be machined.

The process is also known of forging hollow parts using two half-parts of complementary shape which are welded to each other along their peripheral edge provided for said assembly. This requires sophisticated and costly high-frequency welding apparatus and a quality control of the welding in consideration of the external loads placed on the part so formed. This technique requires each of the half-parts to be formed independently and then assembled as indicated above.

Furthermore, combining processes for the foundry casting of materials of the light alloy type followed by a forging phase is also well known through the many patents of the Applicant who originated them with EP patent 119 365 and the developments thereof EP 1250204, EP 1219367. The manufacture of hollow parts by forging and casting has a great and ever-increasing number of applications.

Apart from the patents of the Applicant, a proposal has been made to include a core in the forged part using a hybrid process combining casting and forging. This is disclosed for example in patent EP 850825 which is specific to a cycle pedal crank. The solution described in this document, although interesting, has some drawbacks or limitations.

Prior to the forging operation, the foundry core-prints are removed, and during forging, the core in not in a stable situation. There is also the likelihood of core waste produced during the forging operation causing surface defects.

Patent EP 850825 makes no allowance for the possibilities of the core being deformed when striking during forging. Said patent is restricted to cycle pedal cranks in which the constraints are quite different from those relating to the technical components used in the design of motor vehicles.

A process for manufacturing hollow forgings as defined in patent PCT WO 2009/050382 is also known. The document illustrates and describes the use of a core. However, the process described has a great number of drawbacks. It sets out to seal the blank so that the core is completely isolated from the external environment. This seal is provided by blocking each gas vent used to position the core with a blocking element. Each gas vent is itself blocked by a stiffening element in the form of a rod or metal pin.

According to this patent and as indicated in the description the core-prints associated with the core are positioned in the zones to be machined. To remove the core and the aforementioned associated vents, the process described in the patent requires the part obtained to be drilled and pre-machined in order to knock out the core. This is a very heavy constraint and tricky to implement. The operator must also fettle the final part. Fettling involves recovering miscellaneous and incompatible materials such as aluminium and steel, the aluminium being contained in the forged burr and the steel being the material constituting the sealing means (core pins, added core-prints). This requires sorting in the event of recycling.

Thus in the two patents EP 850 825 and WO 2009/050382 the operations described are costly in both economic and environmental terms.

The process described in this patent presupposes that the part is hollow right through, which restricts the use thereof. In fact, the specifications issued by car manufacturers with whom the applicant works have no requirement for the parts so worked to be hollow in the totality of their volume. The technique described in the patent PCT WO 2009/050382 does not allow for parts to be formed that have both hollow zones and solid zones.

Both aforementioned patents thus have limitations inherent in the processes employed.

BRIEF SUMMARY OF THE INVENTION

The approach adopted by the Applicant has therefore been to completely reconsider the problem posed and to develop a different approach by working firstly on controlling the constraints produced by the forging operation through the deformation of the material and particularly of the core.

The solution found by the Applicant answers this problem with total command of the deformation controls during the operation to forge the hollow part in all or part of its required volume.

The process for manufacturing hollow parts formed in two successive operations of casting material to make a semi-finished product and then forging comprises the following operating phases:

a) definition of the final hollow part in its internal portion to be obtained after forging with deformation of the solid or thinned-down sections according to the environmental and mechanical constraints, b) modelling of the solid and thinned-down sections in the zones of the part that require it, c) formation of the thinned-down section by means of one or more recyclable single-material cores made of sand or salt having operational zones for their required positioning in the mould, said core(s) being for positioning locally at places requiring zones with a thinned-down section, and modelling of said core(s) in the thinned-down sections, d) after modelling of the final part to be obtained and of the core(s), definition of the semi-finished product and of the core(s) in their initial forms having a different configuration from the forged core(s) corresponding to the internal recess or recesses required in the forged part, e) after casting of the metal around said core(s) over all or part of the volume thereof, in the prior initial form to give a semi-finished product with its core(s), striking of said semi-finished product with its core(s) resulting in the part and its core(s) being deformed from their initial shapes to their final shapes, f) fettling of the burrs consisting of casting material and obtained by forging free from materials other than the casting material, g) removal of the recyclable single-material core(s).

According to another feature, the process for manufacturing hollow parts formed in two successive operations, the first of casting material to make a semi-finished product, the second of forging, said process implementing the steps of:

a) Selecting the hollow part to be manufactured, b) Selecting the material for the recyclable single-material core (sand/salt), c) Modelling the hollow part and the single-material core(s) in their desired configuration after forging including the modelling of the operational zones of the core, such as the core-prints of the core necessary for its positioning in the foundry mould, in their configuration after forging, d) Modelling the deformations introduced by the forging, e) With the result of step d) modelling the part and its core prior to forging, i.e. the cast part, and the core in its initial form, f) After casting the metal around said core(s) over all or part of the volume thereof in the prior initial form to obtain a semi-finished product with its core(s), striking said semi-finished product with its core(s) resulting in the part and its core(s) being deformed from their initial shapes to their final shapes, g) Fettling the burrs consisting of casting material, h) Removing the recyclable single-material core(s), is remarkable in that:

the step of modelling the operational zones of the core provides for operational zones of the core emerging at the surface of the part after forging to be located of necessity outside the fettling zones of the part, and in particular outside the parting plane of the forging dies, and sufficiently far removed therefrom, to allow fettling without removing material from the core, and in that fettling is carried out in such a way that the fettling residue, consisting of forged casting material, is free from materials other than said casting material.

These features and others will become clear from the remainder of the description.

BRIEF DESCRIPTION OF THE DRAWING FIGURES

The object of the invention is shown non-restrictively in the drawings wherein

Figure 1:
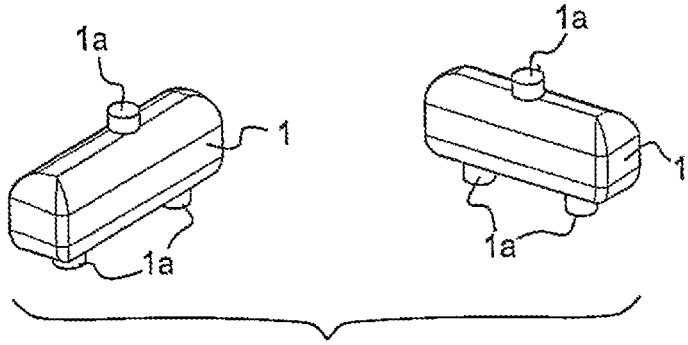
FIG. 1 is a perspective view of an assembly of a plurality of cores intended to be inserted in a part to be cast and then forged. The cores (1) are single-material including their core-prints (1*a*) for positioning them in the mould.
Figure 2:
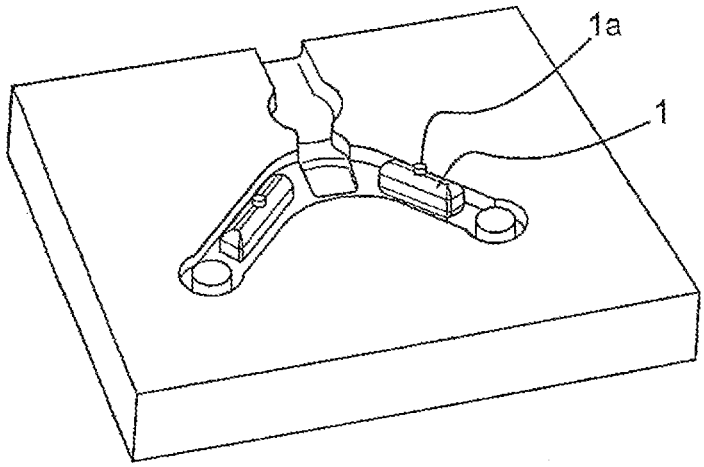
FIG. 2 is a view showing the cores positioned in the foundry mould before the casting operation is performed.
Figure 3:
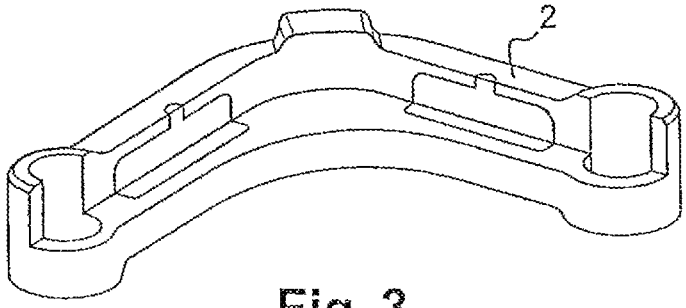
FIG. 3 is a cross-section view showing the semi-finished product (2) obtained after casting, with the 2 cores positioned in the thinned-down zones.
Figure 3A:
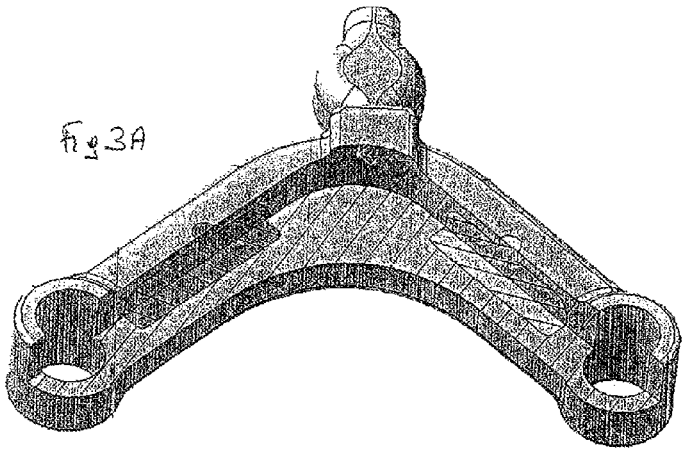
FIG. 3A is identical to FIG. 3, but with hatching shown for a proper understanding of the drawing.
Figure 4A:
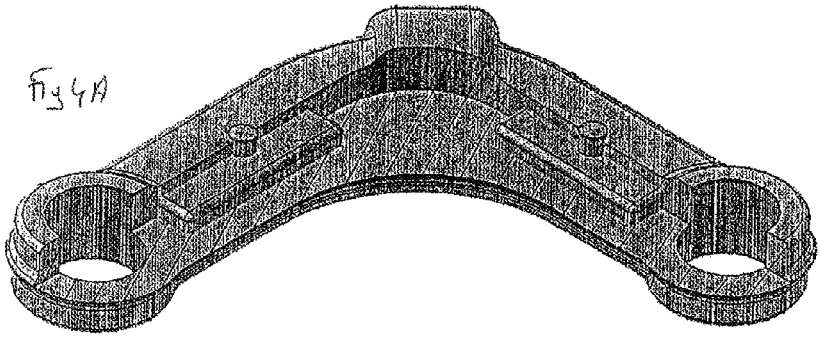
FIG. 4A is identical to FIG. 4, but with hatching shown for a proper understanding of the drawing, FIG. 5 consists of 2 views.
Figure 4A:
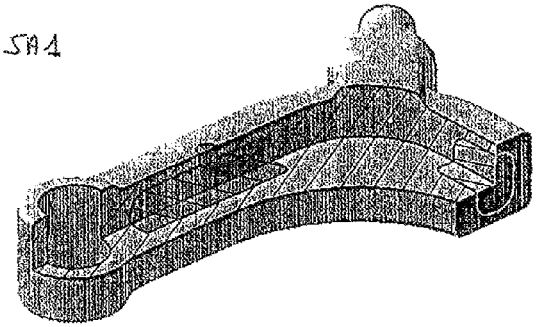
Figure 4A:
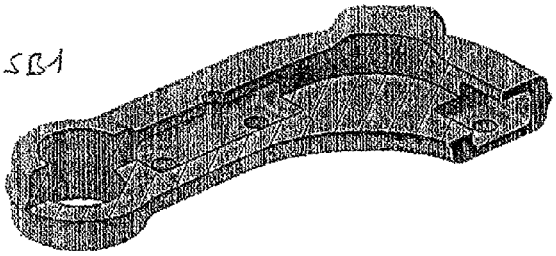
Figure 4:
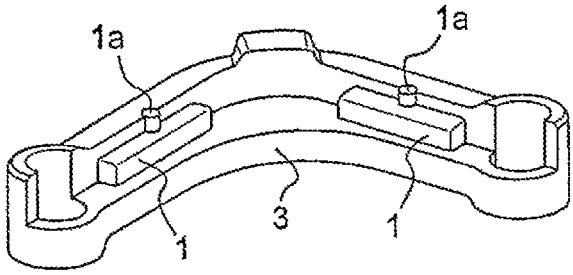
FIG. 4 is a view of a finished forged part (3) with zones including cores (1) in the thinned-down parts and solid zones.
Figure 5:
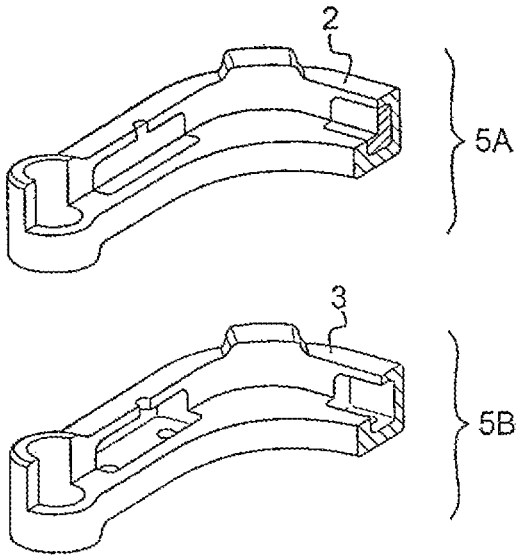

FIG. 5A is a picture of the semi-finished product (2) obtained after casting with its cores in the zones with thinned-down sections and its zones with solid sections. FIG. 5A1 is identical to FIG. 5A, but with hatching shown for a proper understanding of the drawing, FIG. 5B is a picture of this semi-finished product (3) after forging and removal of the cores (1). FIG. 5B1 is identical to FIG. 5B, but with hatching shown for a proper understanding of the drawing.

DETAILED DESCRIPTION

To make the object of the invention more explicit, it is now described non-restrictively as shown in the drawings.

The inventive process is thus distinguished from the prior art by the initial modelling operations of the part including one or more recyclable single-material cores (1) and integrating in the same material their positioning core-prints (1*a*). Said modelling operations allow the definition of the part portions which are to be solid and those which have thinned-down sections through the installation of the cores. Upstream modellings combined with control and understanding of the properties of the materials constituting the part and the core(s) make it possible to simulate the flow of the metal around the core(s) which are deformed during forging. This allows the shape of the core(s) placed in the part to be optimised with a view to its implementation by casting and forging.

Controlling all this data allows us to define the part according to the desired thicknesses.

The inventive process also employs values software incorporating all the data relating to the required finished part, all the data on the core(s), all the data relating to the machine or strike tools, said software calculating all the deformations of the part and of the core(s) so as to define the initial and final shapes to be obtained.

Modelling means that there are no internal flaws since the initial shape of the core(s) is pre-defined in order to meet this objective, and for example, flaw types, such as disengagement of the core in the burr or non-homogeneous thinning-down over all the section under consideration, cannot occur. Modelling means that there are no obvious external flaws such as wrinkling or a trace of crude for example. The burr obtained after forging remains exclusively in the casting material and can be easily fettled and recycled.

The inventive process also makes it possible inter alia to define a stiffness optimisation and moreover to reduce the weight with no detriment to part quality.

There is therefore a freedom in designing the part as a function of the stiffness required which offers wide possibilities with no additional cost.

The core(s) are furthermore selected and defined as having a rate of compression below 0.30 at 1500 MPa.

The core(s) may be of different materials, and in particular be made of sand, but in an optimized version made of salt as required but each core is single-material. The core can be recovered in full after deburring using known methodologies. In particular, the core can be removed in particular by thermal deburring or mechanical deburring when it is made of sand, or by air/water pressure if the core is made of salt. The core(s) are removed conventionally through orifices provided on the shell and the striking die.

The solution provided thus makes it possible to optimise the manufacture of hollow parts made of light alloy in all or part of the volume thereof through the use of alloy casting and part forging. Thus a single part treated via the inventive process may have, depending on the modelling used, a single hollow zone for the accommodation of a core, a plurality of hollow zones alternating with solid zones, the hollow zones accommodating a corresponding number of cores. Additionally the core-prints (1*a*) may be multidirectional.

The process affords many advantages economically and environmentally, it affords great freedom in designing parts and avoids the problems with sealing constraints as identified in patent PCT WO 2009/050382.

The invention claimed is:

1. Process for manufacturing hollow parts formed in two successive operations of casting material to make a semi-finished product and then forging, comprising the following operational phases:

a) defining a final hollow part having an internal recess or recesses to be obtained after forging with deformation of solid or thinned-down sections according to environmental and mechanical constraints, b) modelling of the solid and thinned-down sections in zones of the part, c) formation of the thinned-down sections using one or more recyclable single-material cores made of sand or salt having core-prints made of the recyclable single-material for desired core positioning in a mold, said one or more cores being positioned locally at places requiring zones with a thinned-down section, and modelling of said one or more cores including the core-prints in the thinned-down sections, d) after modelling of the final part to be obtained and of the one or more cores, defining the semi-finished product and the one or more cores in initial forms having a different configuration from the forged one or more cores corresponding to the internal recess or recesses required in the forged part, e) casting of metal around said one or more cores in the initial forms to produce a semi-finished product with the one or more cores, forging and striking of said semi-finished product with the one or more cores resulting in the part and the one or more cores being deformed from the initial forms as to their final shapes, f) fettling of burrs of the casting material obtained by the forging free from materials other than the casting material, and g) removal of the recyclable single-material cores.

2. Process as claimed in claim 1, wherein the one or more cores have a compression rate below 0.30 at 1500 MPa.

3. Process as claimed in claim 1, wherein the core-prints of the one or more cores are multidirectional.

4. Process as claimed in claim 1, wherein defining the semi-finished product and the one or more cores in initial forms includes employing software to calculate deformations of the hollow part and the one or more cores introduced by the forging and striking

5. Process for manufacturing hollow parts formed in two successive operations of first casting material to make a semi-finished product, and second forging, said process implementing the steps of:

a) selecting a hollow part to be manufactured, b) selecting material for at least one recyclable single-material cores from sand and salt, c) modelling the hollow part and the at least one single-material core in a desired final configuration after forging including modelling of operational zones of the at least one core including core-prints of the single-material for core positioning in a foundry mold, in the final configuration after forging, d) modelling deformations introduced by the forging, e) with the result of step d), modelling the part and the at least one core in an initial form prior to forging that is different from the final configuration, f) casting metal around said at least one core over all or part of a volume of the at least one core in the initial form to obtain a semi-finished product with the at least one core, then forging and striking said semi-finished product with the at least one core resulting in the part and the at least one core being deformed from the initial form to the final configuration, g) fettling burrs of the casting material, and h) removing the at least one recyclable single-material core, wherein the step of modelling the operational zones of the at least one core provides for the operational zones emerging at a surface of the part after forging to be located outside part fettling zones, and sufficiently far removed therefrom, to allow fettling without removing material from the at least one core, and wherein fettling is carried out in such a way that fettling residue of forged casting material is free from materials other than said casting material.

6. Process as claimed in claim 5, wherein the step of modelling the operational zones of the cores provides for the operational zones of the cores emerging at a surface of the part after forging to be located outside a parting plane of forging dies.

7. Process as claimed in claim 5, wherein said modelling employs software to calculate the deformations of the hollow part and the at least one single-material core introduced by the forging.

* * * * *